US006299154B1

(12) United States Patent
Ballestrazzi et al.

(10) Patent No.: US 6,299,154 B1
(45) **Date of Patent: *Oct. 9, 2001**

(54) DEVICE DESIGNED TO OPEN AT LEAST ONE PAGE OF A PUBLICATION IN ORDER TO INTRODUCE PRINTED INSERTS

(75) Inventors: Aris Ballestrazzi, Spilamberto; Lamberto Tassi, Savignano sul Panaro, both of (IT)

(73) Assignee: Sitma S.p.A., Spilamberto (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/337,523

(22) Filed: Jun. 22, 1999

(30) Foreign Application Priority Data

Jun. 23, 1998 (IT) ..... MI98U0435

(51) Int. Cl.[7] ..... B65H 5/30; B65H 39/04; B41L 43/14

(52) U.S. Cl. ..... 270/52.24; 270/52.23

(58) Field of Search ..... 270/52.23, 52.24, 270/52.25, 52.27, 52.28

(56) References Cited

U.S. PATENT DOCUMENTS

| | | | | |
|---|---|---|---|---|
| 3,627,302 | * | 12/1971 | Dutro | 270/52.24 |
| 3,661,379 | * | 5/1972 | Dolfini | 270/52.28 |
| 4,401,300 | * | 8/1983 | Morin | 270/52.23 |
| 4,403,770 | | 9/1983 | Ferguson et al. . | |
| 4,420,146 | * | 12/1983 | Reist | 270/52.23 |
| 4,463,941 | * | 8/1984 | Schlough | 270/52.23 |
| 4,478,399 | | 10/1984 | Morin et al. . | |
| 5,253,857 | | 10/1993 | Ballestrazzi et al. . | |
| 5,443,250 | * | 8/1995 | Gosslinghoff | 270/52.23 |
| 5,613,670 | | 3/1997 | Ballestrazzi et al. . | |
| 6,017,027 | * | 1/2000 | Jaeger | 270/52.23 |

* cited by examiner

*Primary Examiner*—Christopher P. Ellis
*Assistant Examiner*—Patrick Mackey
(74) *Attorney, Agent, or Firm*—Oblon, Spivak, McClelland, Maier & Neustadt, P.C.

(57) ABSTRACT

A device designed to open at least one page of a publication in order to introduce printed inserts, fitted in an insert feeding and/or packaging machine, which includes a feed table for publications associated with a product feeding conveyor, at least one sheet feeder being fitted alongside table to feed secondary products, which said device including a suction and lifting element that lifts a lateral portion of said at least one page of a main product, a deflector designed to deflect the lateral portion of said at least one lifted page being fitted downstream of said suction and lifting element, which has a reduced width and is fitted alongside in correspondence of the deflector, where said at least one sheet feeder is located.

9 Claims, 3 Drawing Sheets

DEVICE DESIGNED TO OPEN AT LEAST ONE PAGE OF A PUBLICATION IN ORDER TO INTRODUCE PRINTED INSERTS

BACKGROUND OF THE INVENTION

1. Field of the Invention

This invention relates to a device designed to open at least one page of a publication in order to introduce printed inserts, in particular in an insert feeding and/or packaging machine.

2. Discussion of the Background

Machines called "inserting machines" that feed printed inserts such as a sheet of paper into a publication are known. "Publication" shall be deemed to mean any product, such as a magazine, a two-sided folding leaflet and the like, subsequently called the "main product".

Machines designed to package such products are also known, namely machines in which the main products such as magazines, folding two-sided leaflets and the like are packaged in plastic shrink wrapping material and the like, which contain devices designed to add one or more inserts or secondary products such as a sheet of paper, another leaflet, etc.

These devices, called feeders or inserters, automatically combine the inserts with the main product being packaged.

In order to do so, further devices and/or systems are fitted adjacent to the feeders of the inserting machines and packaging machines which completely raise the first page or other underlying pages of the main product, keeping them all open and raised well above the conveyor and the pushers to allow the insertion of the secondary product.

The devices and/or systems of this kind used at present are particularly bulky, and can cause jamming or stoppage of the packaging machine, which operates at high speed. For example, as they are made in the form of large deflectors which extend above the pusher conveyor, they raise the first page and/or the other pages excessively, causing it to jam in the insert feed elements.

In addition, precisely because of their size, the deflectors currently used are firmly fixed to the structure of the machine, which causes problems if they have to be removed to eliminate jammed paper.

Another drawback is that when the first page or other pages beneath it is fully opened, the inserts fed in may not be correctly aligned and positioned, but may be skewed and misaligned. They may even "leapfrog" the conveyer pusher, or adhere to the upper separation surface as a result of static discharges, which are always present in sheets of paper.

Another drawback is associated with the presence of electrostatic discharges, which are normally present in paper products and cause the pages to stick together so that it is difficult to separate them in order to introduce additional inserts.

SUMMARY OF THE INVENTION

The aim of this invention is therefore to offer a device that opens at least one page and is particularly functional and simple to construct, in order to solve the problems set out above.

Another aim is to offer an opening device which can easily be at least partly removed from the support structure of the insertion and/or packaging machine so as to minimise stoppages in the event of jamming.

In accordance with the present invention, these aims are achieved by a device in an insert feeding and/or packaging machine that opens at least one page of a publication to introduce printed inserts, and includes a feed table for publications associated with a product feeding conveyor, at least one sheet feeder being fitted alongside the feed table to feed secondary products, said device being characterised in that it includes a suction and lifting element which raises a lateral portion of said at least one page of a main product, a deflector designed to deflect the lateral portion of said at least one lifted page being fitted downstream of said suction and lifting element, which has a reduced width and is fitted alongside in correspondence of the deflector, where said at least one sheet feeder is located.

BRIEF DESCRIPTION OF THE DRAWINGS

The characteristics and advantages of a device that opens at least one page in accordance with this invention will become clear from the description below, given by way of example but not of limitation, by reference to the schematic drawings annexed in which.

DESCRIPTION OF THE PREFERRED EMBODIMENTS

Figure 1:
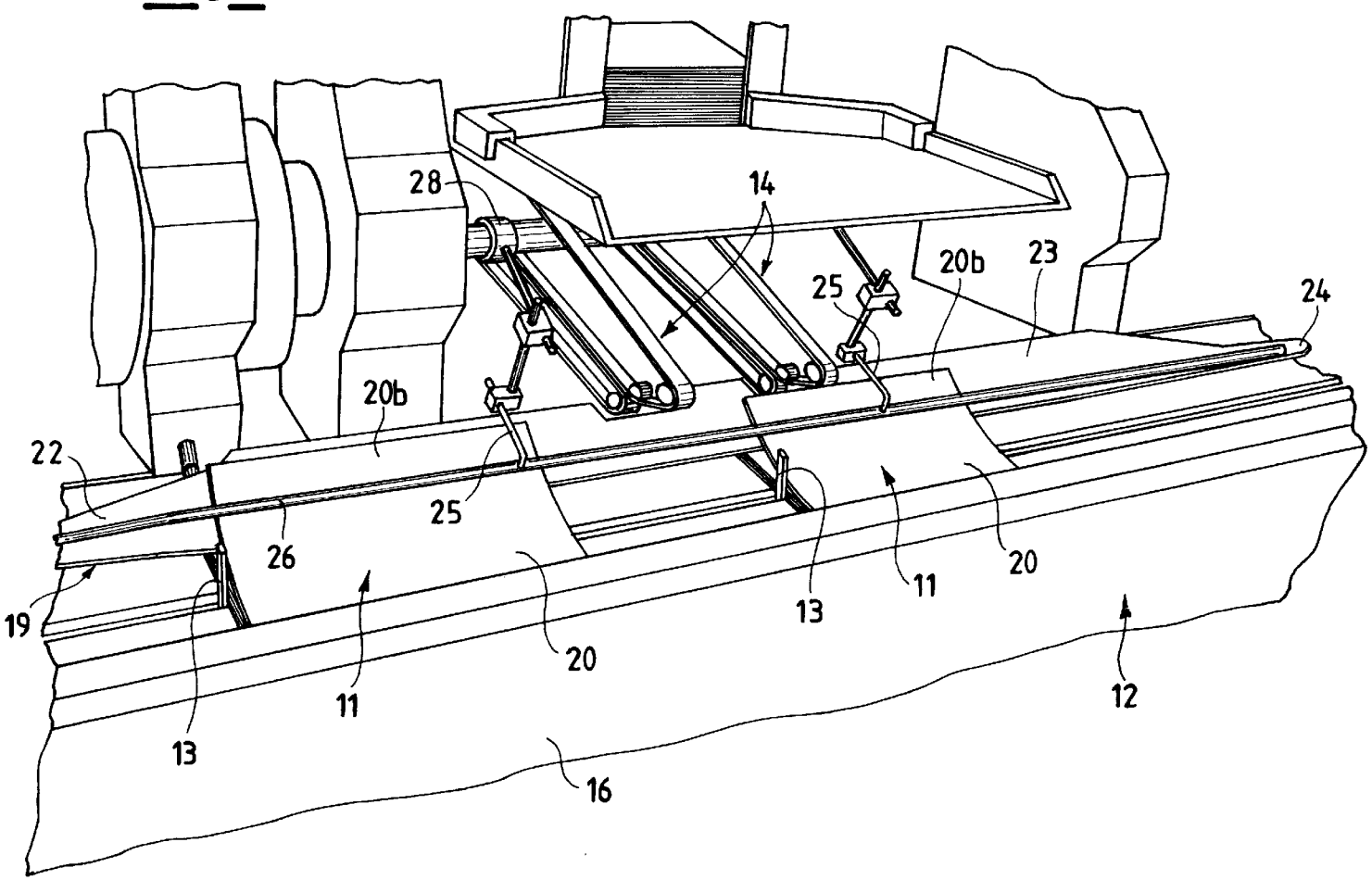
FIG. 1 is a perspective view of part of an insertion and/or packaging machine fitted with a device according to this invention.
Figure 2:
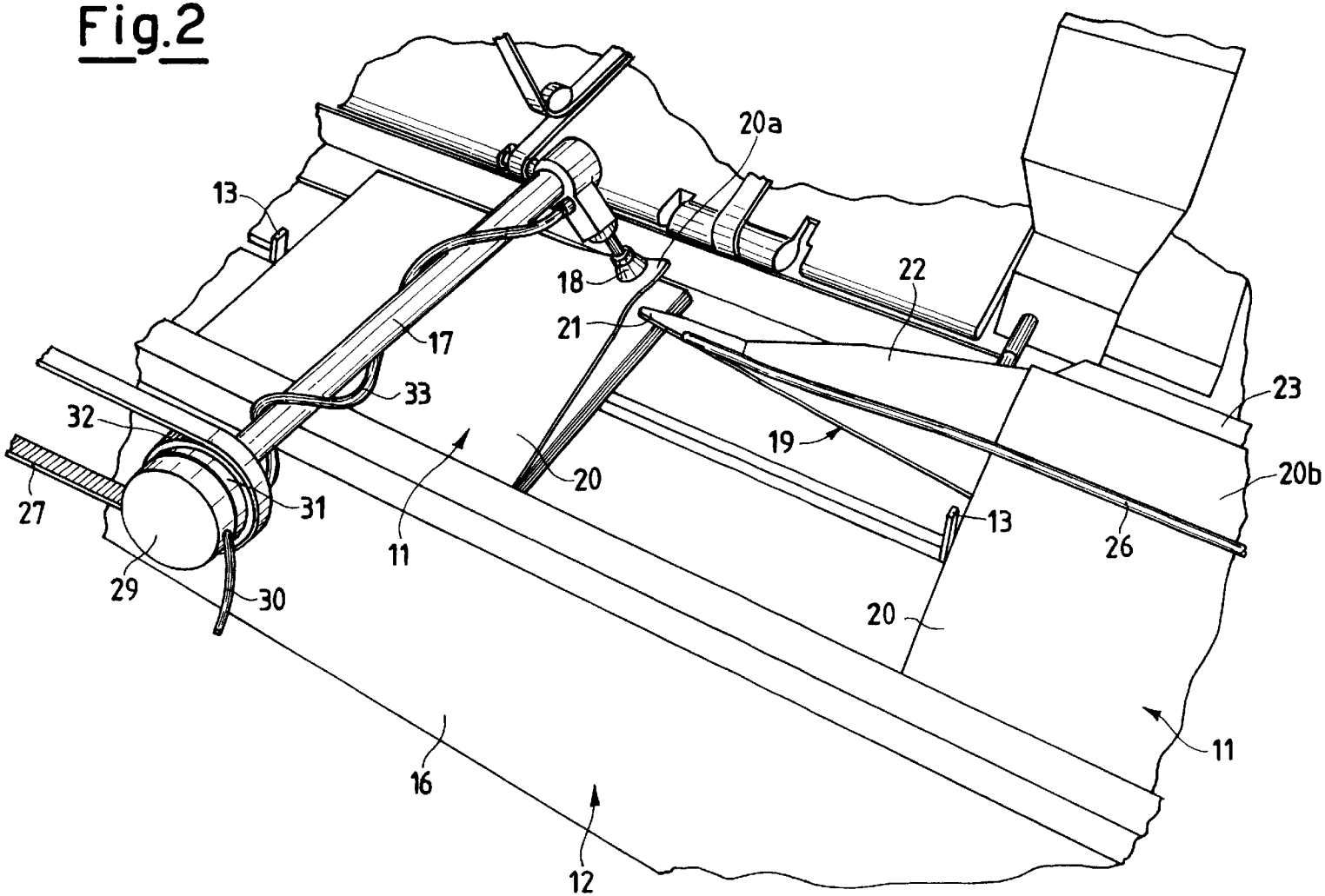
FIG. 2 is a perspective view from a different angle of part of the device shown in FIG. 1.

The Figures very schematically and partially show a portion of an inserting and/or packaging machine in which inserts merely need to be inserted in the main publications 11, such as magazines, two-sided leaflets and the like, so as to make a final product ready for subsequent treatment or packaging in plastic such as shrink wrapping or the like at a subsequent station, which is known and not shown here.

Sheet feeders (or inserters) 14 are fitted on a structure 12 of such a general machine, positioned transversely to a product feeding conveyor, equipped with pushers 13, which runs lengthways to the machine; said feeders are designed to add an insert or secondary product 15 such as a sheet of paper, an additional brochure, etc.

A rotating arm 17 fitted with a suction element 18, such as a suction cup, is installed transversely to feed table 16 of pushers 13. A deflector 19, on which at least a first page 20 of main product 11 rests after being released by suction cup 18, is fitted downstream of said suction element 18. Deflector 19 is narrow and, as shown in the example, may occupy and engage only a limited portion of the free edge of raised page or pages 20 of main product 11.

Said deflector 19 is constituted by an even narrower tapered first front part 21 which is comparable to a "claw", with the free end shaped like a slice of salami and facing upwards or downwards.

A second wider ramp-shaped part 22 extends upwards from said first front part 21 towards the basically flat central portion 23 of deflector 19. The rear end of deflector 19 is shaped to form a downward-sloping ramp 24. The whole deflector 19 is supported by arms 25 integral with structure 12 of the machine so that it is raised above feed table 16 of pushers 13.

In addition, a restraint element, such as rod 26 shown in the example, can be connected at the top to deflector 19 and distanced from it. Said rod 26, which extends above deflector 19 and longitudinally to the product feed, is also supported by arms 25.

Suction cup 18 can obviously grasp and lift the first page only, or other pages attached to it too. It is also obvious that in accordance with this invention, both suction cup 18 and deflector 19 only keep a lateral portion 20*b* of said page 20 or successive pages raised.

From the details described above, it is clear how a device according to the invention would operate in a packaging machine.

In said general machine, main publications 11, such as a magazine as shown in the drawings, are first fed along feed table 16 one after another. Magazine 11 is made to advance by pushers 13 of the conveyor, and is separated from the next one by the same length as the pitch of pushers 13.

When each magazine 11 arrives beneath rotating arm 17, said arm is caused to rotate by a control device, shown in the drawings as a cogwheel or chain 27, so that suction cup 18 comes into contact with front edge 20*a* of a limited lateral portion 20*b* of the first page 20, possibly with other pages beneath it. Rotation of the arm is synchronised with the advance of pushers 13. The suction of suction cup 18 is activated by a valve comprising a fixed part 29 connected to a suction pipe 30, for example connected to a pump (not shown), and a mobile part 31 integral with a cogwheel or pulley 32. The latter is connected to arm 17, to which suction cup 18 is fitted. Another pipe 33, which is connected to mobile part 31 of the valve, extends from suction cup 18. As mentioned, the suction of suction cup 18 is activated, and during part of its rotation, synchronised with the advance of magazine 11, it lifts edge 20*a* of the first page 20 either alone or together with other pages beneath it.

As the advancing movement of magazine 11 continues as a result of the thrust exerted by pusher 13, the front part 21 of deflector 19 is inserted between the remaining unlifted pages of magazine 11 and the front portion of first page 20, and the suction of suction cup 18 is immediately deactivated. For the sake of simplicity, we will only refer to the first page hereafter; however, it should be borne in mind that the suction cup can also lift other pages.

As the advancing movement of the magazine continues further, the first page slides upwards along wider ramp 22, and travels towards central portion 23 of deflector 19. The first page 20 is kept close to the deflector by restraint rod 26.

At this point, a sheet feeder 14 feeds insert 15 into magazine 11 which has thus been partly laterally opened. A number of sheet feeders 14 could obviously be fitted alongside feed table 16, and a number of inserts or secondary products could be inserted in the magazine under first page 20.

When this operation is finished and the sheet feeder or feeders are empty, lateral portion 20*b* of first page 20 is released above the inserts and the remainder of the magazine, descends from the ramp-shaped rear end 22 and thus leaves deflector 19.

Figure 3:
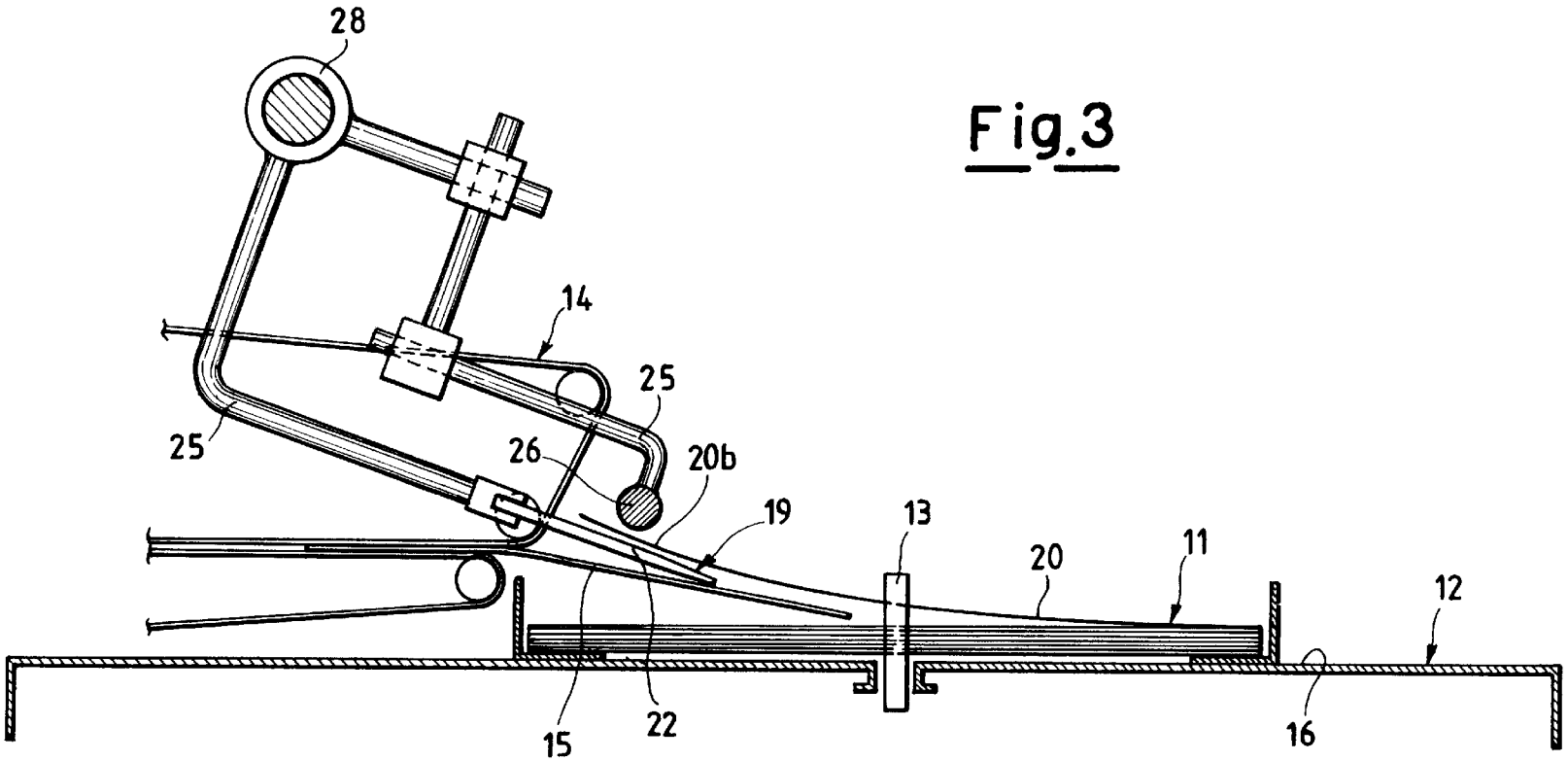
FIG. 3 is a schematic cross-section of the device according to the invention in correspondence with a paper feeder.

In accordance with the invention, deflector 19 is very narrow, as already mentioned, so that the curvature of the page lifted is limited (see FIG. 3). This produces a "pincer" effect on insert or inserts 15 received from each sheet feeder. This effect makes the insert more stable while the magazine containing the insert is advanced by the pushers. In addition, as only the lateral portion of the first page is opened, page opening is facilitated, especially if the pages are made of flimsy paper.

Another advantage deriving from the narrowness of deflector 19 is that it leaves ample room for jamming to be rectified, which is not the case with the devices used to date. Deflector 19 does not extend to the centre line of the conveyor, and therefore does not interfere with pushers 13.

Arms 25 can obviously be constrained to structure 12 of the general machine by hinges 28, as can deflector 19 and restraining rod 26. Such a design would allow said parts to be raised, giving immediate access to the feed table below.

What is claimed is:

1. A device in an insert feeding and packaging machine for opening at least one page of a publication to introduce printed inserts, and including a feed table for publications associated with a product feeding conveyor, at least one sheet feeder being fitted alongside a feed table to feed secondary products, said device comprising a suction and lifting element which raises a portion of said at least one page of a main product, a deflector for deflecting a lateral portion of said at least one lifted page, said deflector being positioned downstream of said suction and lifting element, said suction and lifting element having a reduced width and being positioned in proximity with the deflector wherein said suction and lifting element comprises a suction source and a rotatable arm member which extends over said conveyor and to which the lifting member is mounted, said lifting member having a single suction opening and wherein a suction pipe is positioned so as to extend along the rotatable arm member for communicating said suction source with said single suction opening.

2. A device according to claim 1, wherein the width of said deflector does not reach the centre line of the feed conveyor.

3. A device according to claim 1, wherein said deflector has a front part which is even narrower and acting as a draft element.

4. A device according to claim 3, wherein said narrower front part is claw shaped, with a free end.

5. A device according to claim 3, wherein said narrower front part extends from a second wider ramp-shaped part that leads upwards to a basically flat central portion.

6. A device according to claim 1, wherein said deflector is connected at the top to an element which restrains said at least one page.

7. A device according to claim 1, wherein said deflector is connected to a structure integral with said advance surface by a plurality of arms which are hinged.

8. A device according to claim 1, wherein the pushers of said conveyor feed said products, including said at least one partly open page.

9. A device according to claim 1, wherein said at least one page is the first page of said main product.

* * * * *